US005262620A

United States Patent [19]

Webber et al.

[11] Patent Number: 5,262,620

[45] Date of Patent: Nov. 16, 1993

[54] SHEET COUNTING APPARATUS

[75] Inventors: Simon Webber, Wellington; Anne Sutcliffe, Birmingham, both of United Kingdom

[73] Assignee: Portals Engineering Limited, England

[21] Appl. No.: 834,236

[22] PCT Filed: Jun. 13, 1991

[86] PCT No.: PCT/GB91/00951

§ 371 Date: Feb. 12, 1992

§ 102(e) Date: Feb. 12, 1992

[87] PCT Pub. No.: WO91/20059

PCT Pub. Date: Dec. 26, 1991

[30] Foreign Application Priority Data

Jun. 14, 1990 [GB] United Kingdom ..... 9013335

[51] Int. Cl.[5] ..... B61L 1/16; B65H 3/08

[52] U.S. Cl. ..... 235/98 R; 271/108

[58] Field of Search ..... 235/98 R, 98 A, 98 B; 271/99, 106, 108, 37

[56] References Cited

U.S. PATENT DOCUMENTS

| | | | |
|---|---|---|---|
| 3,297,316 | 1/1967 | Haines | 235/98 R |
| 3,801,777 | 4/1974 | Onoe et al. | 235/98 R |
| 3,838,255 | 9/1974 | Dutton | 235/98 R |
| 3,962,564 | 6/1976 | Dutton | 235/98 R |

*Primary Examiner*—Michael L. Gellner
*Assistant Examiner*—Eddie C. Lee
*Attorney, Agent, or Firm*—Andrus, Sceales, Starke & Sawall

[57] ABSTRACT

A counter for a stack of sheets has a fixed elongate member (21) defining a curved surface (22) in which is formed a vacuum port (23), and a pin (17) extending parallel to the member (21) and arranged to move in a circular orbit therearound. A valve member (25A) is rotatable within the member (21) in synchronism with the motion of the pin (17), and has a port (45) which comes into and out of register with port (23). the corner regions of successive sheets in a stack are drawn in turn on to the curved surface (22) by suction when ports (23) and (45) are in register, so separating the drawn corner from the stack; the pin (17) enters the gap thus created, and transfers that sheet corner to the other side of member (21). The ports (23) and (45) are out of register during this transfer, whereby the corner of the sheet being transferred is no longer held to the member (21).

15 Claims, 4 Drawing Sheets

SHEET COUNTING APPARATUS

This invention relates to a sheet counting apparatus for counting sheets in a stack of sheets.

A number of machines have been devised for counting stacked sheets of papers, card, film, bank notes and the like and examples of such machines are described and illustrated in our UK Patent Nos. 1455110, 1455109, 2106871, 2128784, 2128001, 2128002 and 2127930. All of these machines utilise a generally flat hollow blade having a vacuum port and which is mounted in a cantilever fashion to pivot about an axis parallel to one edge of the blade, there being a pin orbiting in an elliptical or other complex path about the blade, so that when the blade is engaged in a stack of sheets and is pivoted between generally horizontal and downwardly inclined positions in synchronism with the orbiting pin, the corner of the sheet for the time being held by applied vacuum in contact with one side of the blade is separated from the stack and is then transferred by the pin to the other side of the blade. A counting device is triggered each time the mechanism transfers a sheet from one side of the blade to the other. Such arrangements have been highly developed as described and illustrated in the UK Patent Specifications referred to above, but the operation of the hollow blade in the stack coupled with the action of the pin in transferring a sheet from one side of the blade to the other can damage the corners of the sheets. There is also a practical limit on the maximum count rate for such machines, due to dynamic considerations.

It is an object of this invention to devise a sheet counting apparatus in which damage to the corner of a sheet being counted is minimised, and which also may operate at relatively high speeds.

This invention provides a sheet counting apparatus for counting sheets in a stack thereof, comprising transfer means arranged to act on a corner of the stack to separate the sheet corners from the stack on one side of the transfer means and to transfer the separated corners one at a time to the other side of the transfer means, and means to count the sheet corners as they are transferred, said transfer means comprising an elongate static member having, in cross-section, a curved surface in which is formed a vacuum port and which member is arranged to engage in the stack whereby suction applied to the vacuum port may draw on to the curved surface an adjacent sheet corner, a transfer pin extending substantially parallel to said elongate member, means to move the pin in an orbit around the elongate member to transfer a sheet corner drawn on to the curved surface to the other side of the elongate member, and control means to control the supply of suction to the vacuum port to terminate the suction prior to the transfer of the corner by the orbiting pin from one side of the elongate member to the other side thereof and to re-establish the suction to draw the corner of the next sheet in the stack on to the curved surface ready for transfer.

It will be appreciated that in the sheet counting apparatus of this invention, an elongate static member is engaged in the corner region of a stack of sheets. The apparatus is thus simplified in that no mechanism need be provided to drive the member, and as the transfer pin moves continuously in an orbit, the counting rate may be increased as there are no reciprocating parts. Also, the curved surface of the elongate member minimises the angle through which a sheet corner is deformed during the counting process.

Most preferably, the static element comprises a generally cylindrical hollow bar having an outer cylindrical surface and also defining said curved surface, the outer cylindrical surface having a smaller radius of curvature than said curved surface, and the vacuum port in the curved surface communicating with the interior of the bar, whereby suction may be applied to the port through the interior of the bar. The curved surface should blend smoothly with the outer cylindrical surface of the bar.

Advantageously, the control means comprises a valve member mounted for rotation within the bar and which valve member has a port which comes into and out of register with the vacuum port in the curved surface of the bar, means being provided to rotate the valve member in synchronism with the orbiting motion of the pin whereby suction is periodically applied to the vacuum port in a timed relationship to the pin motion. The valve member may take the form of a rotatable hollow spindle extending essentially co-axially within the static member, arranged for rotation synchronously with the pin. By applying the suction continuously to the spindle, the vacuum port will then receive the suction at the appropriate times to draw down the next sheet to be counted, so opening a gap in the stack for the pin, and then releasing that sheet as the transfer of that sheet to the other side of the member commences.

Means may be provided for holding apart the sheet corners of the stack to both sides of the transfer means, and for gradually releasing the sheets to the transfer means. Such holding means may in effect open a gap in the corner region of the stack to receive the transfer means, and release sheets to the transfer means for counting thereby, as the counting proceeds.

The means for counting sheets transferred by the transfer means may take any of a number of forms. For example, there may be an optical device for detecting when a corner of a sheet is transferred by the transfer means, a counter being incremented each time a corner is detected. Alternatively, there may be a counter for each complete orbit of the pin, and means responsive to the instantaneous pressure at the vacuum port to detect when suction is applied to that port but no sheet corner is drawn to the curved surface. If no sheet is present for counting, the vacuum port will remain uncovered even when suction is applied so that the instantaneous pressure will rise and this may be used to inhibit counting of complete orbits of the pin. Of course, combinations of such counting means may be employed to increase the reliability and accuracy of the count.

This invention extends to sheet counting apparatus as defined above in combination with a table for supporting a stack of sheets, and means relatively to move the table and transfer means along the length of the stack as the counting progresses.

By way of example only, one specific embodiment of sheet counting apparatus constructed and arranged in accordance with the present invention will now be described in detail, reference being made to the accompanying drawings, in which.

Figure 1:
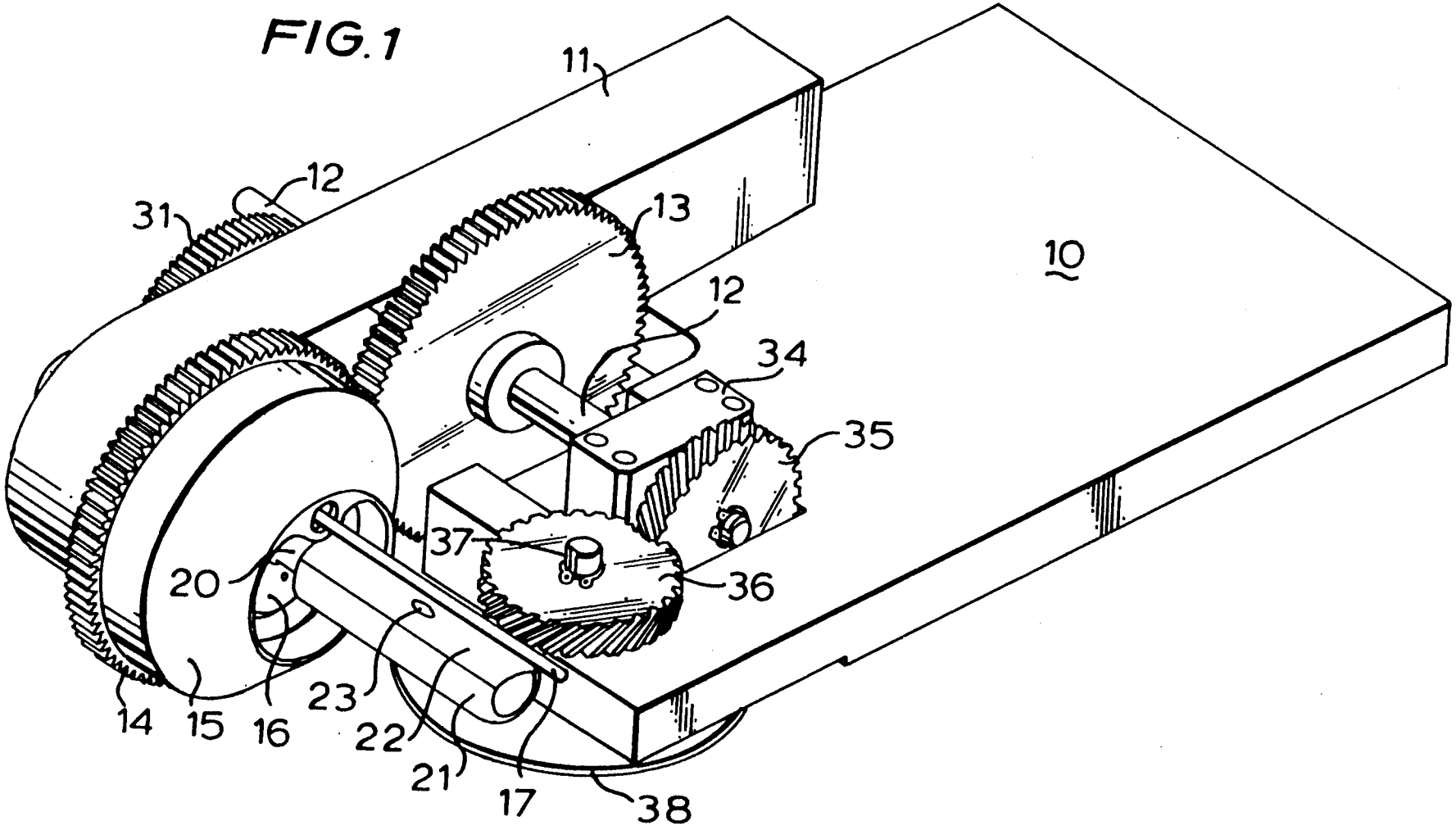
FIG. 1 is a diagrammatic perspective view of the principal parts of the apparatus.
Figure 2:
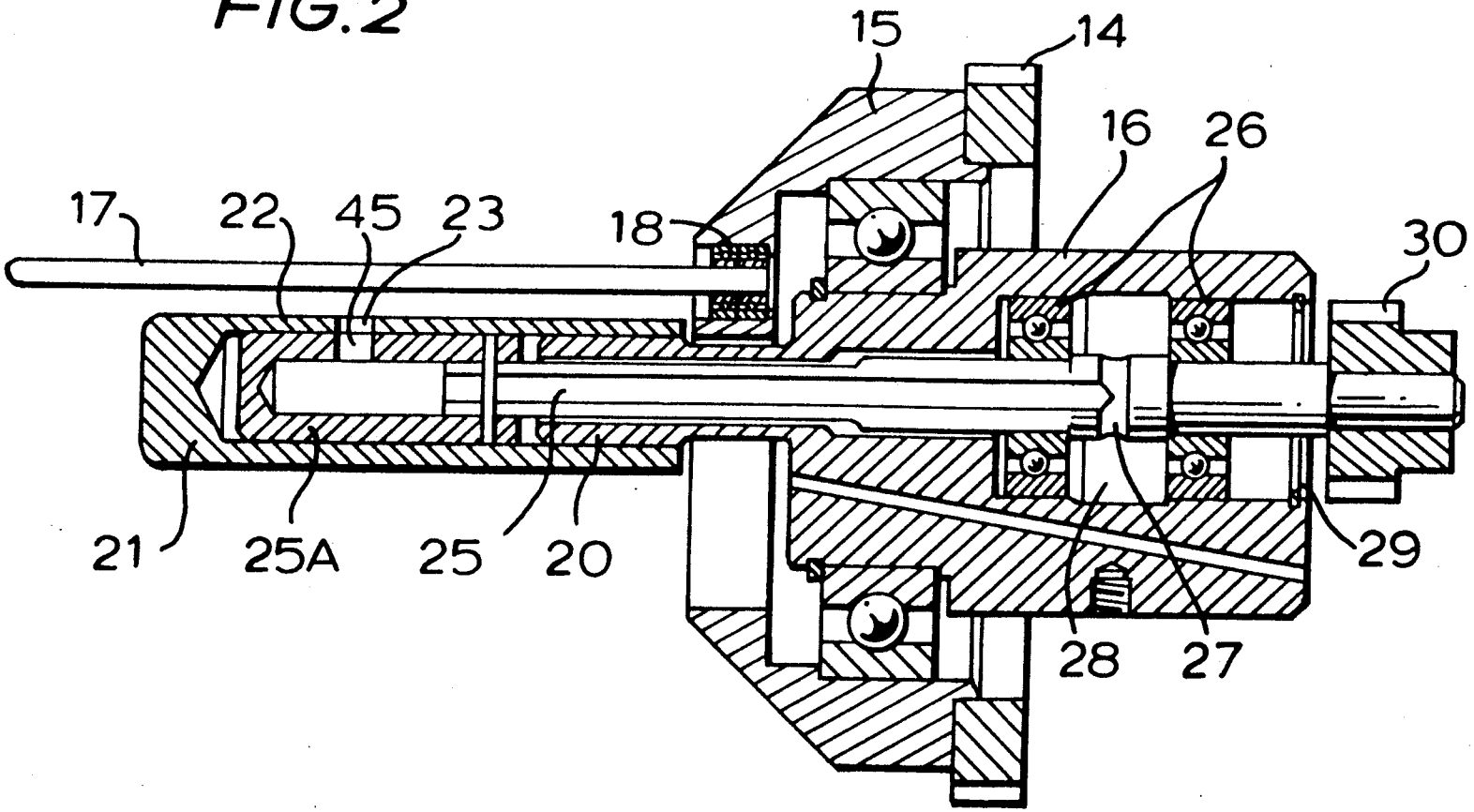
FIG. 2 is a cross-section through the transfer mechanism shown in FIG. 1.

Referring initially to FIGS. 1 and 2, the principal parts of the embodiment of sheet counting apparatus constructed in accordance with the present invention and arranged to act on a corner of a stack of sheets (not shown) include a base plate 10 supporting a bracket 11 in which is journalled a drive shaft 12. Locked to shaft 12 is gear 13 meshing with teeth 14 formed in an outer ring 15 of the sheet transfer mechanism. The ring 15 is rotatably mounted on a static boss 16 secured to the bracket 11 and carries a transfer pin 17 arranged to extend parallel to the rotational axis of the ring 15. The transfer pin 17 is mounted for rotation in a low friction bearing 18.

Boss 16 has a hollow arm 20 which extends parallel to the rotational axis of ring 15, and has an elongate outer sleeve 21 secured thereto, which sleeve has a generally circular cross-sectional external shape, but includes a surface 22 of an increased radius of curvature blending smoothly with the cylindrical surface. A vacuum port 23 is formed in the surface 22.

Rotatably mounted within the arm 20 is a spindle 25 carried on bearings 26 provided within a counterbore in the boss 16, the spindle having a bore extending from the spindle end remote from the bearing 26. Pinned to the spindle is a valve member 25A rotatably disposed within the sleeve 21, the valve member having a valve port 45 which comes into and out of register with the vacuum port 23 on rotation of the spindle. A cross-drilling 27 in the spindle 25 connects the spindle bore to a chamber 28 formed in the boss 16, to which chamber is connected a suction (vacuum) source. A seal member 29 is provided in the counter-bore to effect a seal around spindle 25 adjacent its free end, and a pinion 30 is secured to the end of the spindle 25 beyond the seal member 29.

Rotatably mounted on bracket 11 is an idler gear 31 which meshes with pinion 30 provided on the spindle 25 and with a similar pinion (not shown) mounted on the drive shaft 12. The gear trains are arranged so that on rotation of the drive shaft 12 by a motor (not shown), the transfer pin 17 orbits around the sleeve 21 in a circular path at the same rate as spindle 25 is turned within arm 20, but in the opposite sense, so turning the valve member 25A to bring the connected vacuum source into and out of communication with the vacuum port 23.

Figure 4:
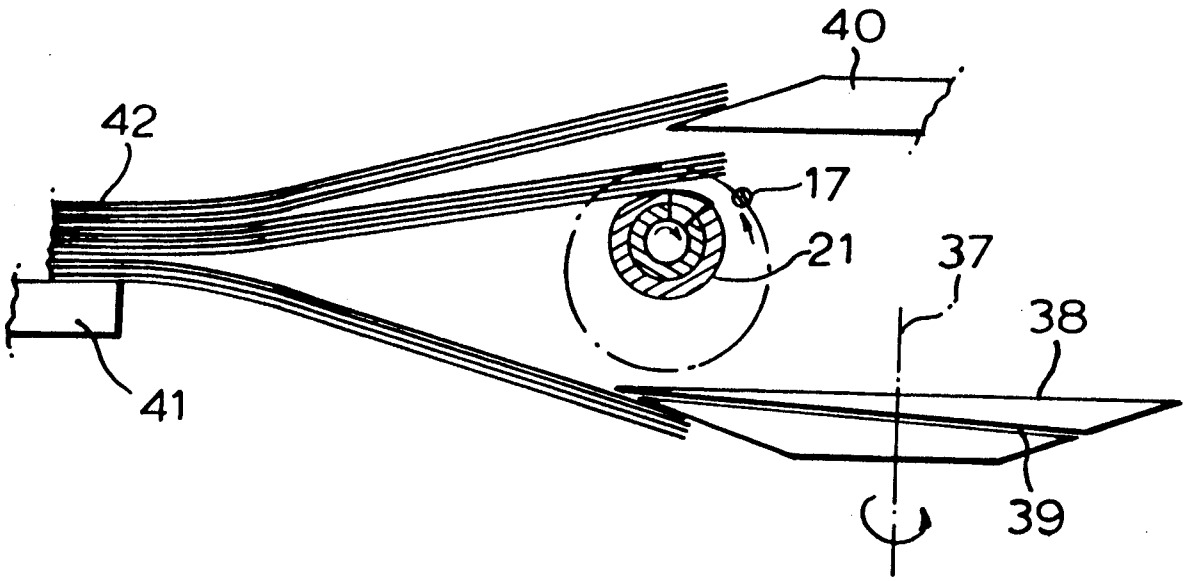
FIG. 4 diagrammatically illustrates a stack separator which may be used in conjunction with the transfer means.

The base plate 10 supports a mounting block 34 through which the drive shaft 12 extends and carries at its free end a helical gear 35 meshed with a similar helical gear 36 secured to shaft 37 extending through the base plate 10. A conical support drum 38 is secured to shaft 37 beneath the base plate 10, and has a helical groove 39 formed in its conical surface, as shown in FIG. 4. A support finger 40 (FIG. 4) is attached to the block 34, to extend forwardly towards sleeve 21.

The sheet counting apparatus using the transfer mechanism described above is completed by a table 41 (FIG. 3A) to support a stack of sheets to be counted, the table having suitable guides to locate the stack and a clamping arrangement therefor. The table is relatively movable with respect to the transfer mechanism in the direction normal to the plane of the base plate 10. A counting mechanism (not shown) is also provided, which increments a counter each time a sheet is transferred by the transfer mechanism. Such a counting mechanism may operate by monitoring the vacuum applied to the spindle 25, the count being incremented for each rotation of the outer ring 15 so long as a depression below some predetermined datum is present. Alternatively, an optical counting arrangement may be provided, to sense the transfer of a sheet by pin 17.

Referring now to FIGS. 3A to 3D, there is illustrated the sequence of operation of the transfer mechanism described above. A stack 42 of sheets is supported on the table 41 such that the corners of the sheets to be counted are inclined upwardly relative to the transfer mechanism 43, as illustrated at 44. At the position illustrated in FIG. 3A, the valve port 45 in valve member 25A is in register with the vacuum port 23 in the sleeve 21 and the corner of the sheet 46 next to be counted has been drawn on to the curved surface 22 by the reduced air pressure. The transfer pin 17 is moving in its circular orbit to enter the gap thus formed between the lowermost uncounted sheet 46 and the corners of the next sheets in the stack.

Figure 3A:
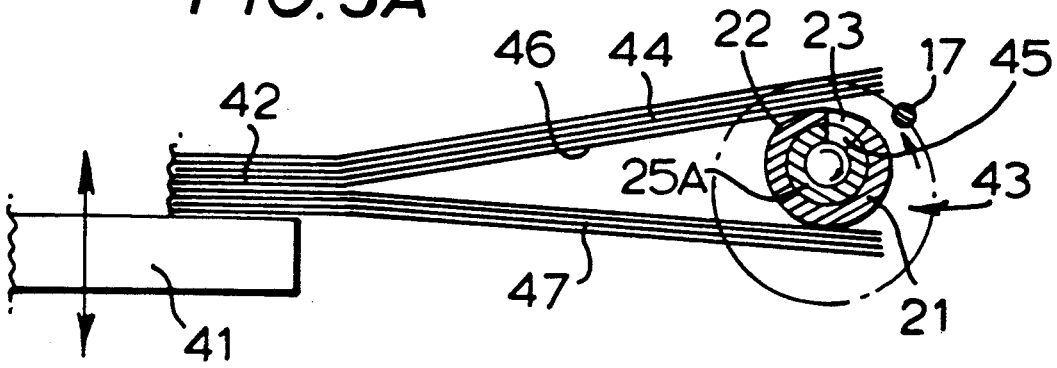
FIGS. 3A to 3D illustrate the sequence of operation of the apparatus.
Figure 3B:
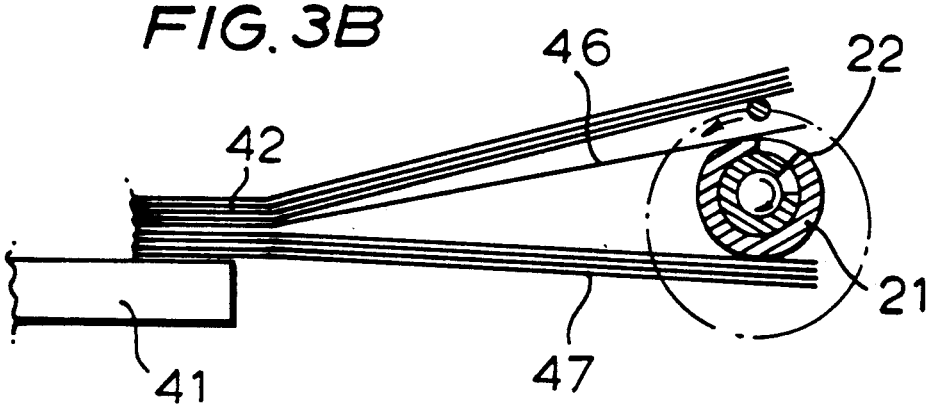
Figure 3C:
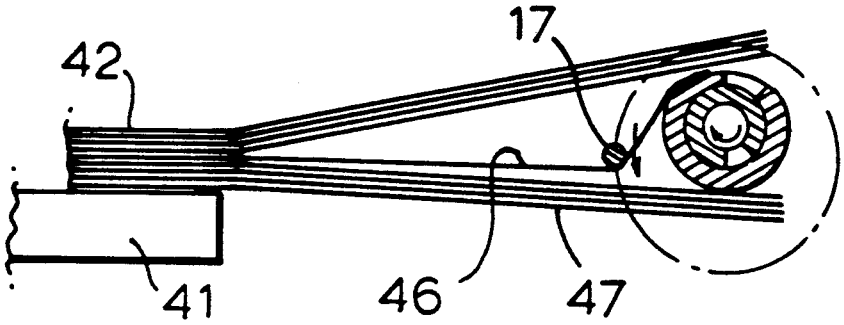
Figure 3D:
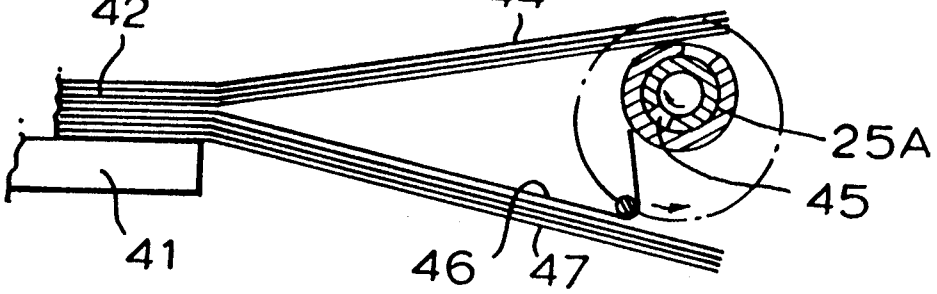

In FIG. 3B, the port 45 in the valve member 25A has just moved out of register with the vacuum port 23, so releasing the corner of sheet 46, but the pin 17 has entered the gap between that sheet 46 and the remaining uncounted sheets, so separating that sheet 46 from the stack. Continued movement of the pin 17 in its orbit pulls sheet 46 towards the already-counted sheets 47, as illustrated successively in FIGS. 3C and 3D. The pin 17 continues in its orbit until the sheet 46 has been laid on the already counted sheets and then, shortly before the position of FIG. 3A is reached once more, the port 45 in valve member 25A comes back into register with the vacuum port 23 so that the corner of the next sheet to be counted is drawn on to surface 22.

It will be appreciated that the above counting sequence may be operated very rapidly since there are only smoothly rotating components, and a sheet is held by the vacuum applied to port 23 only at the beginning of the sheet transfer process, so minimising the likelihood of damage occurring to the corner of the sheet being counted. A counter may be arranged to be incremented for each full turn of the pin 17, provided that there is no detected increase in the pressure within the spindle 25, which will occur when the last sheet of a stack has been counted and the valve port 45 in the valve member next registers with the vacuum port 23.

FIG. 4 illustrates a modification of the above described counting sequence, using a support finger 40 in conjunction with rotatable conical support drum 38, mentioned above. The support drum 38 and support finger 40 are arranged to reduce the loading on the transfer mechanism, and also to minimise the likelihood of damage occurring to the corners of sheets as they are transferred from one side to the other of the sleeve 21. As the counting operation proceeds, the table 41 supporting the stack of sheets is moved relative to the sleeve 21, and so also relative to the support finger 40 which projects by a short distance into the stack of sheets to be counted, above the sleeve 21. Such movement of the table (and stack) relative to the support finger 40 allows sheets to transfer from one side of the finger to the other, so that the number of sheets resting on the arm 20 and awaiting counting is relatively small.

Each time a sheet is transferred by the pin 17, the lower corner of that sheet is picked up by the helical groove 39 in the support drum 38, the rotation of which is timed to the rotation of the pin 17, and that corner is thus transferred to the lower side of the support drum 38, where it rests on the conical surface of that support drum. In this way, the stack of counted sheets is held clear of the orbiting pin 17, so eliminating vibration which otherwise would occur each time the pin strikes the stack of already-counted sheets.

We claim:

1. Sheet counting apparatus for counting sheets in a stack thereof, comprising transfer means arranged to act on a corner of the stack to separate the sheet corners from the stack on one side of the transfer means and to transfer the separated corners one at a time to the other side of the transfer means, and means to count the sheet corners as said corners are transferred, said transfer means comprising an elongate static member having, in cross-section, a curved surface in which is formed a vacuum port and said elongate static member is arranged to engage in the stack whereby suction applied to the vacuum port may draw on to the curved surface an adjacent sheet corner, a transfer pin extending substantially parallel to said elongate static member, means to move said transfer pin in an orbit around said elongate static member to transfer a sheet corner drawn on to said curved surface to the other side of said elongate static member, and control means to control the supply of suction to said vacuum port to terminate the suction prior to the transfer of the corner by the orbiting transfer pin from one side of said elongate static member to the other side thereof and to re-establish the suction to draw the corner of the next sheet in the stack on to said curved surface ready for transfer.

2. Sheet counting apparatus as claimed in claim 1, wherein said elongate static member comprises a generally cylindrical hollow bar which said hollow bar has an outer cylindrical surface and also defines said curved surface, said outer cylindrical surface having a smaller radius of curvature than said curved surface, and the vacuum port in said curved surface communicating with the interior of said hollow bar, suction being applied to the port through the interior of said hollow bar.

3. Sheet counting apparatus as claimed in claim 1, wherein said elongate static member and said transfer pin are mounted in cantilever manner on a mechanism for non-rotatably supporting said elongate static member, for moving said transfer pin in said orbit around said elongate static member, and for communicating suction to said vacuum port.

4. Sheet counting apparatus as claimed in claim 1, wherein means are provided for holding apart the sheet corners of the stack to both sides of the transfer means, and for gradually releasing the sheets to the transfer means.

5. Sheet counting apparatus as claimed in claim 1, wherein the means to hold the corners of the stack apart on both sides of said transfer means comprise first means to engage the uncounted sheets of the stack and to release sheets to the transfer means, and second means located on the other side of the transfer means to collate counted sheets into the stack on the other side of the transfer means.

6. Sheet counting apparatus as claimed in claim 5, wherein said first means comprises a blade engaging the corner of the stack and arranged gradually to release sheets to the transfer means.

7. Sheet counting apparatus as claimed in claim 5, wherein said second means comprise a rotatable member having a helical slot in which is engaged the corner of a sheet transferred by the transfer means, to restack the transferred sheet on the side of the member remote from the transfer means.

8. Sheet counting apparatus as claimed in claim 7, wherein said rotatable member has a conical outer surface in which said helical groove is formed, the restacked sheets bearing on the conical surface thereof.

9. Sheet counting apparatus as claimed in claim 1, wherein the means for counting sheets transferred by the transfer means comprise at least one of an optical device for detecting when a corner of a sheet is transferred by the transfer means, and a counter for complete orbits of said transfer pin in association with means responsive to the instantaneous pressure at the vacuum port to detect when suction is applied to that port but no sheet corner is drawn to the curved surface.

10. Sheet counting apparatus as claimed in claim 1, wherein said means to move said transfer pin causes said transfer pin to move in an elliptical or circular orbit.

11. Sheet counting apparatus as claimed in claim 1, in combination with a table for supporting a stack of sheets, and means relatively to move the table and transfer means along the length of the stack as the counting progresses.

12. Sheet counting apparatus for counting sheets in a stack thereof, comprising transfer means arranged to act on a corner of the stack to separate the sheet corners from the stack on one side of the transfer means and to transfer the separated corners one at a time to the other side of the transfer means, and means to count the sheet corners as said corners are transferred, said transfer means comprising an elongate static member and a transfer pin, said elongate static member comprising a generally cylindrical hollow bar having an outer cylindrical surface in which is formed a curved surface, said outer cylindrical surface having a smaller radius of curvature than said curved surface, a vacuum port being formed in said curved surface and communicating with the interior of said hollow bar, said elongate static member being arranged to engage in the stack whereby suction applied to the vacuum port though the interior of said hollow bar may draw on said curved surface an adjacent sheet corner, said transfer pin extending substantially parallel to said elongate static member, means to move said transfer pin in an orbit around said elongate static member to transfer a sheet corner drawn on to said curved surface to the other side of said elongate static member, and control means to control the supply of suction to said vacuum port to terminate the suction prior to the transfer of the corner by the orbiting transfer pin from one side of said elongate static member to the other side thereof and to re-establish the section to draw the corner of the next sheet in the stack on to said curved surface ready for transfer, said control means comprising a valve member mounted for rotation within said hollow bar and which said valve member has a port which comes into and out of register with the vacuum port in the curved surface of said hollow bar, means being provided to rotate said valve member in synchronism with the orbiting motion of said transfer pin whereby suction is periodically applied to the vacuum port in a timed relationship to said transfer pin motion.

13. Sheet counting apparatus as claimed in claim 12, wherein means are provided for holding apart the sheet corners of the stack to both sides of said transfer means, and for gradually releasing the sheets to the transfer means, said holding apart means comprising first means to engage the uncounted sheets of the stack and to release sheets to the transfer means, and a rotatable member having a helical slot in which is engaged the corner of a sheet transferred by the transfer means, to restack the transferred sheets on the side of the member remote from the transfer means.

14. Sheet counting apparatus as claimed in claim 13, wherein the means for counting sheets transferred by the transfer means comprise at least one of an optical device for detecting when a corner of a sheet is transferred by the transfer means, and a counter for complete orbits of said transfer pin in association with means responsive to the instantaneous pressure at the vacuum port to detect when suction is applied to that port but no sheet corner is drawn to the curved surface.

15. Sheet counting apparatus as claimed in claim 13, in combination with a table for supporting a stack of sheets, and means relatively to move the table and transfer means along the length of the stack as the counting progresses.

* * * * *